US005965514A

United States Patent [19]

Wierenga et al.

[11] Patent Number: 5,965,514

[45] Date of Patent: Oct. 12, 1999

[54] COMPOSITIONS FOR AND METHODS OF CLEANING AND DISINFECTING HARD SURFACES

[75] Inventors: Thomas James Wierenga, Cincinnati; Bruce Barger, West Chester, both of Ohio

[73] Assignee: The Procter & Gamble Company, Cincinnati, Ohio

[21] Appl. No.: 08/753,974

[22] Filed: Dec. 4, 1996

[51] Int. Cl.[6] ..... C11D 1/835

[52] U.S. Cl. ..... 510/433; 510/503; 510/504

[58] Field of Search ..... 510/191, 214, 510/238, 503, 504, 433

[56] References Cited

U.S. PATENT DOCUMENTS

| | | | |
|---|---|---|---|
| 3,849,348 | 11/1974 | Hewitt | 252/547 |
| 3,943,234 | 3/1976 | Roggerkamp | 424/343 |
| 3,983,079 | 9/1976 | Spadini et al. | 252/545 |
| 4,065,409 | 12/1977 | Flanagan | 252/528 |
| 4,165,334 | 8/1979 | Gosselink et al. | 260/458 |
| 4,320,033 | 3/1982 | Yoshikawa | 252/547 |
| 4,391,726 | 7/1983 | Koster | 252/99 |
| 4,397,776 | 8/1983 | Ward | 252/527 |
| 4,443,363 | 4/1984 | Klinger | 252/547 |
| 4,507,219 | 3/1985 | Hughes | 252/118 |
| 4,576,729 | 3/1986 | Paszek et al. | 252/106 |
| 4,606,850 | 8/1986 | Malik | 252/528 |
| 4,678,606 | 7/1987 | Akhter et al. | 252/542 |
| 4,690,779 | 9/1987 | Baker et al. | 252/546 |
| 4,776,974 | 10/1988 | Stanton et al. | 252/106 |
| 5,000,867 | 3/1991 | Heinhuis-Walther et al. | 252/106 |
| 5,008,030 | 4/1991 | Cook et al. | 252/106 |
| 5,389,306 | 2/1995 | Wierenga et al. | 252/547 |
| 5,399,296 | 3/1995 | Wierenga et al. | 252/547 |
| 5,435,935 | 7/1995 | Kupneski | 252/156 |
| 5,476,615 | 12/1995 | Hall et al. | 252/547 |

FOREIGN PATENT DOCUMENTS

| | | | |
|---|---|---|---|
| 0 130 786 | 1/1985 | European Pat. Off. | C11D 7/08 |
| 0 255 978 | 2/1988 | European Pat. Off. | C11D 3/40 |

*Primary Examiner*—John Hardee
*Attorney, Agent, or Firm*—Karen F. Clark; Daniel F. Nesbitt

[57] ABSTRACT

Concentrated mildly acidic hard surface cleaning compositions having a superior combination of cleaning and disinfecting comprise, by weight of concentrated composition:

from about 0.5 to about 40% amine oxide detergent;

from about 0 to about 4% nitrogen-containing chelant; and from about 1 to about 30% quaternary disinfectant.

When the concentrated composition is diluted to form a diluted composition having a concentration of amine oxide of 0.5%, at least 10% of the amine oxide detergent within the diluted composition is protonated; the diluted composition has a surface tension of about 27 dynes per $cm^2$ or less and a pH of from about 3 to about 7. Diluted cleaning compositions prepared from the concentrated compositions comprise from about 40 ppm to about 12,500 ppm of an amine oxide detergent, and from about 50 ppm to about 1500 ppm of a quaternary disinfectant (quat), and have a surface tension of about 27 dynes per $cm^2$ or less; at least 10% of the amine oxide detergent within the diluted cleaning composition is protonated.

6 Claims, No Drawings

COMPOSITIONS FOR AND METHODS OF CLEANING AND DISINFECTING HARD SURFACES

FIELD OF THE INVENTION

This invention relates to compositions for and methods of disinfecting and leaning hard surfaces.

BACKGROUND OF THE INVENTION

Amine oxides are commonly used as cosurfactants to boost and maintain suds formation in laundry, shampoo, and dishwashing detergent compositions. Amine oxides have been used in hard surface cleaners such as acidic toilet bowl cleaners (pH of 2 or less), dishwashing liquids containing occlusive emollients (pH of 4 to 6.9), and selected non-acidic (neutral to alkaline) hard surface cleaners. In non-acidic hard surface cleaners, amine oxide detergent surfactants are essentially non-ionic ($pK_a$ between about 4 and about 6). These nonionic amine oxides provide good cleaning properties and leave little or no visible residue on hard surfaces when they dry.

U.S. Pat. No. 5,435,935, issued to Kupneski, Jul. 25, 1995, herein incorporated by reference, discloses the use of quaternary ammonium (quats) compounds in alkaline liquid hard surface cleaning compositions.

Alkaline (non-acidic) hard surface cleaners containing amine oxides will often significantly stain or discolor vinyl hard surfaces, such as floor tiles, resulting in a light yellow to dark brown discoloration of the vinyl. Staining will also occur on waxed vinyl surfaces where areas of wax are worn thin or are chipped away so that the amine oxide can come in direct contact with the vinyl.

A mildly acidic hard surface cleaning composition containing an amine oxide surfactant will not stain vinyl surfaces, but it renders the quaternary ammonium disinfectants (quats) ineffective in that the quats lose their ability to disinfect.

SUMMARY OF THE INVENTION

It is therefore an object of this invention to obviate the various problems of the prior art.

It is another object of this invention to provide mildly acidic hard surface cleaning compositions containing both amine oxide detergent surfactant and disinfecting quat that will clean, disinfect, cause minimal or no vinyl staining, and leave no visible residue or finish damage upon drying.

It is yet another object of this invention to provide methods for improving disinfectancy of a quaternary disinfectant in a protonated amine oxide containing cleaning composition.

It is also an object of this invention to provide processes for cleaning vinyl surfaces using such compositions.

In accordance with one aspect of the present invention there is provided mildly acidic hard surface cleaning compositions having a superior combination of cleaning, disinfecting and waxed floor finish compatibility. The compositions leave no residue or finish damage after drying. The invention also related to concentrated cleaning compositions which comprise, by weight of the concentrated composition:

- from about 0.5 to about 40% of amine oxide detergent; preferably about 1 to about 25%;
- from about 1 to about 30% of quaternary disinfectant (quat); preferably about 2 to about 16%; and
- from about 0 to about 4% nitrogen-containing chelant.

When the concentrated cleaning composition is diluted to form a diluted composition having a concentration of amine oxide of 0.5%, at least 10% of the amine oxide detergent within the diluted composition is protonated. The diluted composition has a surface tension of about 27 dynes per $cm^2$ or less and a pH of from about 3 to about 7.

In accordance with another aspect of the present invention there is provided diluted hard surface cleaning compositions comprising from about 40 parts per million (ppm) to about 12,500 ppm of amine oxide detergent; from about 50 ppm to about 1500 ppm of quaternary disinfectant (quat). The diluted compositions have a surface tension of about 27 dynes per $cm^2$ or less and a pH of from about 3 to less than about 7, preferably from more than about 3 to less than about 7, more preferably from about 4 to about 6; at least about 10% of the amine oxide detergent within the diluted compositions is protonated.

In accordance with yet another aspect of the present invention there is provided methods for improving the disinfectancy of a quaternary disinfectant in a protonated amine oxide containing cleaning composition by reducing the surface tension to about 27 dynes per $cm^2$ or less.

DETAILED DESCRIPTION OF THE INVENTION

The mildly acidic dilute and concentrated liquid compositions of the present invention comprise amine oxide detergent surfactant and quaternary ammonium disinfectant, and have a surface tension of about 27 dyne per $cm^2$ or less and a pH of from about 3 to less than about 7, preferably from more than about 3 to less than about 7, more preferably from about 4 to about 6. At least 10% of the amine oxide surfactant in the compositions is protonated. In order to obtain an appropriate pH and level of amine oxide protonation, the compositions may comprise an acidifying agent. In order to obtain an appropriate surface tension the compositions may further comprise a surface tension reducing agent.

The liquid compositions can be used to clean hard surfaces in diluted or undiluted form. The concentrated or diluted forms are useful as urinal and toilet bowl cleaners. The diluted form is preferred as a no-rinse hard surface cleaner. Rinsing is desirable if concentrated compositions are used on certain hard surfaces such as floors, but is generally not required if diluted compositions are used. To disinfect hard surfaces, the product should provide at least about 500 ppm to about 700 ppm of quat. To sanitize the product should provide about 50 ppm to about 250 ppm quat. The level of quat is dependent on the organism of interest and the inherent effectiveness of the quat used.

Preferred are concentrated aqueous compositions that have a pH of from about 3 to less than about 7. The concentrated compositions are generally diluted with a sufficient amount of water such that the diluted cleaning compositions deliver from about 40 ppm to about 12,500 ppm of amine oxide detergent, from about 50 ppm to about 1500 ppm of quat, and have a surface tension of about 27 dynes per $cm^2$ or less, preferably 26.5 dynes per $cm^2$ or less.

The concentrated compositions can be used as is or diluted, generally both the concentrated compositions and diluted compositions have a surface tension of about 27 dynes per $cm^2$ or less. The concentrated compositions can be diluted with an aqueous carrier liquid, preferably water, at a concentrated composition to aqueous carrier liquid ratio of about 1:1 to about 1:600 by volume or weight. The preferred ratio level is from about 1:10 to about 1:600, more preferably from about 1:20 to about 1:300, and most preferably about 1:30 to about 1:260.

The concentrated compositions of this invention preferably have, by weight of the concentrated composition: from about 0.5 to about 40%, preferably from about 1 to about 30%, more preferably from about 1 to about 25%, amine oxide detergent surfactant; from about 1 to about 25%, preferably from about 1 to about 20%, and more preferably from about 2 to about 16%, quaternary disinfectant.

The concentrated compositions can comprise an effective amount of an acidifying agent; an effective amount is an amount sufficient to protonate at least 10% of the amine oxide in the concentrated composition, and to provide the concentrated and diluted compositions with a pH of from about 3 to less than about 7. Preferably the concentrated compositions will comprise, by weight, from about 0.05 to about 10%, more preferably from about 0.5 to about 5%, of an acidifying agent. The concentrated and dilutes compositions will have a pH of from about 3 and less than about 7, preferably from more than about 3 to less than about 7, more preferably from about 4 to about 6. The acidifying agent generally has at least one $pK_a$ of less than 6.0, preferably less than about 5.0, more preferably less than about 4.0.

The concentrated compositions may comprise an effective amount of surface tension reducing agent; preferably the concentrated compositions comprise from about 0.005 to about 2%, more preferably from about 0.1 to about 1%, of surface tension reducing agent. The concentrated composition may comprise from about 0 to about 4%, preferably from about 0.25 to about 4%, more preferably from about 1 to about 3%, of nitrogen-containing chelant such as ethylenediamine tetra acetic acid (EDTA), nitrilotriacetic acid (NDTA), diethylene triamine pentaacetic acid (DTPA) or salts thereof.

These liquid hard surface cleaning and disinfecting compositions have excellent disinfecting and cleaning properties, and leave little or no visible residue when they dry. They can be no-rinse compositions. The compositions are safe for modern floor finishes, and cause minimal or no staining of vinyl hard surfaces.

A preferred concentrated composition of this invention comprises, by weight of the concentrated composition: about 1 to 25% amine oxide surfactants; about 2 to 16% quaternary ammonium disinfectant; optionally about 1 to 3% EDTA; about 0.2 to 2% of an acidifying agent such as hydrochloric acid, phosphoric acid and mixtures thereof;

about 0.01 to 2% of surface tension reducing agent such as sodium perchlorate, sodium dioctyl sulfosuccinate and mixtures thereof; and the balance water. The pH is preferably adjusted with hydrochloric acid or phosphoric acid or mixtures thereof to a pH of from about 3 to about 6.

Parts per million (ppm) is used herein as ppm by weight of relatively dilute aqueous liquid compositions. Weight ppm and volume ppm are about the same since both the dilute and concentrated compositions of this invention have specific gravities of about 1.0. Some concentrated compositions will have specific gravities that vary slightly, but they are considered within the scope of the claimed invention in view of this disclosure.

In one embodiment of the present invention, the cleaning compositions are concentrated liquid compositions from which mildly acidic dilute liquid compositions can easily be obtained by adding an aqueous carrier liquid. The present invention also embodies a non-liquid formulation from which the liquid composition can be derived. The non-liquid formulation is essentially the liquid composition wherein the amount of the aqueous carrier liquid is reduced (e.g., gel) or essentially eliminated (e.g., granules).

The mildly acidic liquid compositions can be used as no-rinse hard surface cleaners on floors, walls, toilets, etc. Non-acidic liquid disinfecting and cleaning compositions containing amine oxides will stain vinyl surfaces like floor tiles. However, the liquid compositions of the present invention cause minimal or no vinyl staining. Moreover, the liquid compositions have excellent disinfecting and cleaning properties and leave little or no visible residue after drying.

The present invention also relates to methods for disinfecting and cleaning hard surfaces using the liquid compositions herein. In accordance with the methods, the liquid compositions are applied to a hard surface, wiped with a porous material, and allowed to dry.

Surface tension is a measure of the interfacial free energy per unit area at the boundary between a liquid and the air above it. Surface-active materials (surfactants) significantly change the amount of work required to expand an interface, e.g., the amount of energy that must be put into a liquid to create a bubble.

As used herein, the term "surface tension reducing agent" includes any material that will reduce the surface tension of the cleaning compositions to about 27 dynes per $cm^2$ or less, whereby the disinfecting efficacy of the cleaning compositions of this invention is increased. The surface tension reducing agents may be any suitable solvent, surfactant, acid or acid salt.

Surface tension can be measured by any means commonly known in the art. All surface tensions disclosed herein were measured using a Kruess K12 Tensionmeter, and all measurements were performed at room temperature.

An important feature of the invention is that the surface tension of the dilute acidic amine oxide/quat containing composition is about 27 dynes per $cm^2$ or less to provide disinfectancy on gram positive organisms.

As used herein, "mildly acidic" means a pH in of from about 3.0 to less than about 7.0. All pH values herein are measured in aqueous systems at 25° C. (77° F.).

As used herein, "vinyl" means material or surfaces containing polyvinyl chloride. Such material or surfaces can be waxed or unwaxed.

As used herein, "non-liquid" means granular, powder or gel formulations which can be diluted with the aqueous carrier liquid described hereinafter to produce a mildly acidic liquid hard surface cleaning composition of the present invention.

As used herein, "liquid compositions" means the mildly acidic, liquid hard surface cleaning and disinfecting compositions of the present invention, or aqueous dilutions thereof.

As used herein, "disinfectancy" means the ability to inhibit growth of gram positive and/or gram negative bacteria. As used herein, "hospital grade disinfectancy" means the ability to inhibit growth of both gram positive and gram negative bacteria.

As used herein, all percentages, ppm and ratios are based on weight of the composition. Materials are assumed to be 100% active, unless otherwise specified.

The present invention, in its product and process aspects, is described in detail as follows.

AMINE OXIDE DETERGENT SURFACTANT

The compositions comprise at least one amine oxide detergent surfactant, which typically has a $pK_a$ of from about 4 to about 6. Values for $pK_a$ of amine oxides can be found in literature references such as *The CRC Handbook of Chemistry and Physics 62th ed.,* The Chemical Rubber Company, 1981. Additionally, one of ordinary skill will appreciate that the $pK_a$ of a compound can be calculated through titration. Examples of such calculations are set forth in references such as *Chemical Analysis* 2nd ed., H. A.

Laitinen and W. E. Harris, McGraw-Hill, Inc., 1975, Chapter 3, pages 27–53, incorporated herein by reference. As described hereinafter, at least about 10% to about 100% of the amine oxide species within the composition must be in a cationic or protonated form.

Concentrated compositions according to the invention can be diluted to provide ready-to-use diluted cleaning compositions. The preferred concentrated compositions comprise, by weight of the concentrated composition, from about 0.5 to about 40%, preferably from about 1 to about 30%, more preferably from about 1 to about 25%, most preferably 2 to 18% of the amine oxide detergent surfactant.

Commercially available amine oxides are typically aqueous formulations containing from about 20% to 40%, by weight, amine oxide. The activity of such amine oxide stock solutions refers to the concentration of amine oxide, i.e., a stock solution referred to as "30% active" comprises about 30% amine oxide. One of ordinary skill in the art will appreciate that the amount of amine oxide stock solution required to obtain a chosen level of amine oxide will vary depending upon the activity of the amine oxide stock solution used. Solid amine oxides are preferred for use in solid or granular detergent formulations. Methods for preparing amine oxides in dry formulation include forming an aqueous solution of an amine oxide salt and an organic sulfonic acid or a fatty alcohol half-ester of sulfuric acid, and extracting the resulting salt with a water-immiscible organic solvent; preparing an amine oxide formulation wherein at least some of the amine oxide is in dihydrate form; or forming a precipitate by admixing maleic acid with an aqueous amine oxide solution, and separating out the precipitate. See, for example, Wierenga et al., U.S. Pat. Nos. 5,389,306 and 5,399,296.

The amine oxide preferably has the formula RR'R"NO, where R is a substituted or unsubstituted alkyl or alkene group containing from about 8 to about 30, preferably from about 8 to about 18 carbon atoms, more preferably from about 12 to about 18 carbon atoms, even more preferably from about 12 to about 14 carbon atoms. Amine oxides with alkyl or alkene groups of more that about 18 carbon atoms tend to have decreased solubility, while amine oxides with alkyl alkene groups of fewer than 10 carbon atoms tend to increase vinyl staining. Groups R' and R" are each substituted or unsubstituted alkyl or alkene groups containing from about 1 to about 18, preferably from about 1 to about 4, carbon atoms. More preferably, R' and R" are each methyl groups, examples of which include dodecyldimethyl amine oxide, tetradecyldimethyl amine oxide, hexadecyldimethyl amine oxide, octadecyldimethyl amine oxide, and coconut alkyl dimethyl amine oxides.

The amine oxide detergent surfactant can be prepared by known and conventional methods. One such method involves the oxidation of tertiary amines in the manner set forth in U.S. Pat. No. 3,223,647 and British Patent 437,566. In general terms, amine oxides are prepared by the controlled oxidation of the corresponding tertiary amines.

Examples of suitable amine oxide detergent surfactants for use in the compositions include dodecyldimethyl amine oxide, tridecyldimethyl amine oxide, tetradecyldimethyl amine oxide, pentadecyldimethyl amine oxide, hexadecyldimethyl amine oxide, heptadecyldimethyl amine oxide, octadecyldimethyl amine oxide, docecyldiethyl amine oxide, tetradecyldimethyl amine oxide, hexadecyldiethyl amine oxide, octadecyldiethyl amine oxide, dodecyldipropyl amine oxide, tetradecyldipropyl amine oxide, hexadecyldipropyl amine oxide, octadecyldipropyl amine oxide, dodecyldibutyl amine oxide, tetradecyldibutyl amine oxide, hexadecyldibutyl amine oxide, octadecyldibutyl amine oxide, dodecylmethylethyl amine oxide, tetradecylethylpropyl amine oxide, hexadecylpropylbutyl amine oxide, and octadecylmethylbutyl amine oxide.

Also useful are the amine oxide detergent surfactants which are prepared by the oxidation of tertiary amines prepared from mixed alcohols obtainable from coconut oil. Such coconut alkyl amine oxides are preferred from an economic standpoint inasmuch as it is not necessary, for the present purposes, to separate the mixed alcohol fractions into their pure components to secure the pure chain length fractions of the amine oxides.

QUATERNARY AMMONIUM DISINFECTANTS

The compositions contain at least one water miscible quat, and may optionally contain other substances having disinfectants properties. The key disinfectants are quaternary ammonium compounds. Suitable quaternary ammonium compounds are those known in the detergency art for topical application to hard surfaces.

The preferred quaternary ammonium disinfectant has the formula:

$$[R_1R_2R_3R_4N]^+X^-$$

wherein $R_1$ and $R_2$ are each independently selected from the group consisting of substituted or unsubstituted alkyl or alkylene groups containing from about 8 to about 20 carbon atoms, preferably from about 12 to about 18 carbon atoms, and benzyl groups, there being normally no more than one benzyl group; and $R_3$ and R4 are each independently selected from the group consisting of substituted or unsubstituted alkyl or alkylene groups containing from about 1 to about 4 carbon atoms and benzyl groups, there being normally no more than one benzyl group. X is a halogen atom, sulfate group or nitrate group. Examples of suitable quaternary ammonium disinfectants include dioctyl, octyldecyl and didecyl dimethyl ammonium chloride, N-alkyl ($C_{12}$ to $C_{18}$) dimethyl benzyl ammonium chloride, and N-alkyl ($C_{12}$ to $C_{18}$) dimethyl ethylbenzyl ammonium chloride and mixtures thereof. These disinfectants are preferably used herein at a pH of about 3 to about 6.

The combination of amine oxide surfactant, quat disinfectant, low surface tension and mildly acidic pH provides superior disinfecting properties without the cleaning negatives, particularly the cleaning and/or staining negatives of comparable prior art compositions. The composition, when diluted, has a quat level of from about 50 to about 1500, with a target in use level of from about 500 to about 700 ppm for disinfectancy and of from about 50 to about 250 ppm for sanitizing; however, different levels of quat are useful depending on the organism against which efficacy is desired. Suitable quats are disclosed in U.S. Pat. No. 5,435,935, issued to Kupneski, Jul. 25, 1995, herein incorporated by reference in its entirely.

ACIDIFYING AGENT

It was found that amine oxide staining of vinyl surfaces can be reduced or eliminated by using certain acidifying agents in the liquid composition. These acidifying agents are used to protonate a percentage of amine oxide species in the liquid composition. It was also found that these protonated or cationic amine oxides species reduce (i.e., at 10% protonation) or eliminate (i.e., at 70–100% protonation) staining thus increasing the lifetime of the vinyl surface.

The concentrated composition herein preferably comprises from about 0.05 to about 10%, more preferably about 0.25 to about 5%, most preferably about 0.5 to about 2%, of at least one acidifying agent. The acidifying agent generally has at least one $pK_a$ below about 6.0, preferably below about 5.0, and more preferably below 4.0. When selecting an acidifying agent, at least one $pK_a$ of the acidifying agent should be less than that of the selected amine oxide, preferably from about 1 to about 2 units less. The acidifying agents provide for protonation of the amine oxide species in the compositions.

The acidifying agent can comprise an acid selected from, but not limited to, organic acids, mineral acids, or mixtures thereof. Preferred mineral acids are, but not limited to: HCl, $HNO_3$, $H_3PO_4$, $HClO_4$, and mixtures thereof. Preferred organic acids are, but not limited to, sulfosuccinic acid, methane sulfonic acid, glycerophosphoric acid, ethylenediaminetetraacetic acid ($H_4EDTA$), diethylenetriaminepentaacetic acid ($H_5DTPA$), maleic acid, malonic acid, salicylic acid, tartaric acid, fumaric acid, citric acid, o-phthalic acid, malic acid, itaconic acid, lactic acid, ascorbic acid, 2,2-dimethylsuccinic acid, succinic acid, benzoic acid, and propionic acid. The acidifying agent is more preferably selected from the group of sulfosuccinic acid, citric acid, salicylic acid, phosphoric acid, nitric acid, hydrochloric acid, perchloric acid, oxalic acid, maleic acid, o-phthalic acid, $H_4EDTA$, and mixtures thereof. Most preferred are phosphoric acid, hydrochloric acid, nitric acid, perchloric acid, maleic acid, $H_4EDTA$, sulfosuccinic acid and mixtures thereof.

The liquid compositions contain enough of the acidifying agent to establish a composition pH of between about 3.0 and below about 7.0, preferably between about 4.0 and about 6.0, more preferably between about 4.0 and about 5.5. Liquid amine oxide compositions employed on hard surfaces at a pH of less than about 3.0 can damage waxed or marble surfaces, and when employed at a pH of 7.0 or above will cause excessive staining of hard surfaces that contain vinyl.

The liquid compositions must also contain enough of the acidifying agent to protonate at least about 10% of the amine oxide species within the composition, preferably between about 50% and about 100%, more preferably between about 70% and 100%. As used herein, the term "protonated" refers to cationic amine oxide species containing a quaternary ammonium group. The protonation or conversion of nonionic to cationic amine oxides is represented generally by the reaction formula:

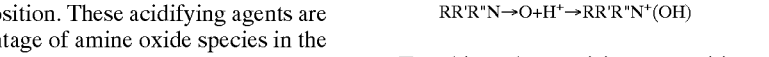

$$RR'R''N\rightarrow O+H^+\rightarrow RR'R''N^+(OH)$$

To achieve the requisite composition pH and amine oxide protonation, the concentration of the preferred acidifying agents will typically be between about 0.05 and about 10%, more typically between about 0.1 and about 7%, by weight of the liquid concentrated compositions. Acid concentrations will vary depending on the $pK_a$ of the amine oxide, the strength ($pK_a$) of the selected acidifying agent, the target pH of the composition, and the relative acidity/basicity of other materials in the composition. Since mineral acids tend to have lower $pK_a$ than organic acids, target pH values are more easily obtained with mineral acids. Mineral acids can be combined with weaker organic acids to more easily reach the target pH.

The liquid compositions can be used in diluted or undiluted form to clean hard surfaces. Disinfectant and sanitizing compositions must be registered with the EPA as pesticides so they must be used as registered to disinfect. The compositions will typically be diluted with an aqueous liquid, usually tap water, prior to use. When diluted, the compositions comprise from about 40 ppm to about 12,500, preferably from about 100 ppm to about 2800 ppm, of the amine oxide detergent surfactant. Whether diluted or undiluted, the liquid composition employed on hard surfaces must have the requisite composition pH and amine oxide protonation described herein.

The requisite pH of the composition is maintained by the amine oxide component. Amine oxide detergent surfactants normally have an adequate buffering capacity in the pH range described herein. Even when diluted with tap water, the amine oxide component can normally maintain the composition pH below 7.0. Additional optional buffers can be added if necessary to help maintain acidity.

The vinyl staining described herein comes from the dehydrochlorination of polyvinyl chloride surfaces. It is believed that this dehydrochlorination reaction is accelerated by nonacidic amine oxide compositions.

Dehydrochlorinated polyvinyl chloride has a yellow to brown appearance, depending on the degree of dehydrochlorination. This dehydrochlorination is believed to be accelerated by nonionic amine oxide species found in nonacidic liquid hard surface cleaners. By protonating the amine oxide to the extent described herein, and by maintaining an acidic environment, the rate of dehydrochlorination is greatly reduced and vinyl staining is reduced or eliminated. In the liquid compositions herein, the protonated amine oxides cannot initiate the dehydrochlorination reaction, so staining stops.

Table I shows that mildly acidic, liquid amine oxide compositions of the present invention cause little or no staining when used on vinyl tiles.

TABLE I

Vinyl Tile Staining Decreases with Amine Oxide Protonation

| Composition | Acidifying agent | $pK_a$ of acidifying agent | Concentration of acidifying agent (%) | Composition pH | Degree of vinyl staining |
|---|---|---|---|---|---|
| A | none | none | none | 8.0 | severe |
| B | $H_3PO_4$ | 2.12, 7.12, 12.32 | 1.1 | 4.6 | none |

TABLE I-continued

Vinyl Tile Staining Decreases with Amine Oxide Protonation

| Composition | Acidifying agent | $pK_a$ of acidifying agent | Concentration of acidifying agent (%) | Composition pH | Degree of vinyl staining |
|---|---|---|---|---|---|
| C | HCl | very low | 1.4 | 4.7 | light |
| D | $HNO_3$ | very low | 2.5 | 4.7 | none |
| E | Maleic acid | 2.00, 6.26 | 2.1 | 4.7 | none |
| F | Oxalic acid | 1.19, 4.21 | 1.5 | 4.7 | light |
| G | O-Phthalic acid | 3.10, 5.27 | 3.1 | 4.6 | light |
| H | Tartaric acid | 3.02, 4.54 | 2.8 | 4.6 | light |
| I | Citric acid | 3.06, 4.74, 5.40 | 2.5 | 4.6 | light |
| J | Malic acid | 3.40, 5.05 | 2.6 | 4.6 | light/ moderate |
| K | Succinic acid | 4.19, 5.57 | 2.3 | 4.8 | light/ moderate |
| L | Acetic acid | 4.76 | 2.5 | 4.9 | moderate |

Each composition (A-L) contains nine (9) % of coconut dimethyl amine oxide and 7.7% of didecyl dimethyl ammonium chloride.

To generate the data summarized in Table I, the following vinyl staining method is employed. This method accelerates staining, but it correlates well with long term vinyl staining under normal conditions in the field. In accordance with this method, white vinyl floor tiles are rinsed with warm tap water, followed by two rinses with isopropanol before they are allowed to air dry. About 1 cc of each concentrated composition A-L is separately applied to discrete regions of the tiles. The tiles are kept at room temperature for 1 hour and then placed in an oven at 60° C. (140° F.) for 1 hour, 45 minutes. The tiles are removed from the oven and allowed to cool to room temperature. The cooled tiles are then rinsed with tap water, dried, and the treated regions of each tile are visually inspected for vinyl staining. The degree of staining is rated as "none" (no color change), "light" (very slight but noticeable discoloration), "moderate" (yellow color change) or "severe" (brown color change).

Composition A is the control product. It has a pH of about 8.0. Essentially 100% of the amine oxide surfactant is therefore in its nonionic form. This composition (A) causes severe staining.

Compositions B-I were mildly acidic amine oxide compositions where 70–100% of the amine oxide species are protonated with acidifying agents having at least one $pK_a$ value below about 3.0. Compositions B-I caused little or no vinyl staining.

Compositions J - L contain weaker acids ($pK_a$ values above about 3.0) which causes only light to moderate staining. Note however, that all of the mildly acidic compositions (B-L) cause significantly less staining than composition A which has a much higher pH (8.0) and therefore has less than 10% of the amine oxide species in its cationic form.

Disinfectancy Decreases with Amine Oxide Protonation

It has been found that under mildly acidic conditions, protonated amine oxides severely limit quat disinfectancy on gram positive (i.e., Staphylococci) bacteria. Without being bound by theory, it is believed that protonated amine oxides (cationic) compete for binding sites on the cell wall with the quat (cationic) disinfectants. Quats are believed to be bactericidal because they destroy the integrity of the cell membrane by disrupting the interactions between the membrane proteins and lipids. Since the surface of the bacterium is normally negatively charged, this helps attract and bind quat (positively charged) disinfectants. Since the protonated amine oxide ($AOH^+$) is also cationic, the quat and the $AOH^+$ compete for the same binding sites. $AOH^+$ appears to have little or no inherent bactericidal activity so the overall disinfectancy of the mixture is reduced dramatically (see Table II). Formulations M-Q (Table II) are based on Comparative Example 1. No surface tension reducing agents are included in formulations M-Q and their pH's are adjusted with phosphoric acid and/or hydrochloric acid.

TABLE II

Increased Protonated Amine Oxide Decreases Quat Disinfectancy

| Composition | Solution pH | % AO | % $AOH^+$ | Disinfectancy Results |
|---|---|---|---|---|
| M | 8.0 | 100 | 0 | 0/10 (Pass) |
| N | 7.0 | 100 | 0 | 0/10 (Pass) |
| O | 6.0 | 97 | 3 | 2/10 (Fail) |
| P | 5.0 | 76 | 24 | 6/10 (Fail) |
| Q | 4.0 | 24 | 76 | 10/10 (Fail) |

The Environmental Protection Agency (EPA) measures disinfectant efficacy using the AOAC Use-Dilution Method. In a test, test tube carriers are inoculated with the bacterium of interest (Staphylococcus aureus in this example) and it is then treated with the test product. After a fixed incubation period, the carriers are evaluated for the presence of live bacteria. Results are reported as the number of tubes showing growth relative to the number of tubes inoculated. It should be noted that the data reported in Table II is a screening test because only 10 tubes are inoculated. Results of 0/10 indiciate no bacteria (0) growth in the 10 tubes tested (pass), 10/10 indicates growth in all 10 tubes (failure). In a screening test, growth in one (1) tube is considered a failure.

While not being bound by theory, it is believed that the protonated amine oxide ($AOH^+$) is not bactericidal because it either cannot pass through the cell wall because of its chemical structure or that the interstitial pH (>7) of the cell quickly deprotonates the amine oxide rendering it ineffective.

SURFACE TENSION REDUCING AGENTS RESTORE DISINFECTANCY

It has been surprisingly discovered that disinfectancy can be restored (on gram positive bacteria in a liquid mildly acidic amine oxide formulation in which amine oxide is protonated) by reducing the surface tension of the liquid formula. Without being bound by theory, it is believed that lower surface tension forces more quat disinfectant to the surface of the bacterium to overcome the "blocking" effect of the protonated amine oxide.

In the compositions of the present invention in order to insure quat disinfection on gram positive organisms in the presence of a protonated amine oxide, the surface tension of the dilute composition must be about 27 dynes per $cm^2$ or less, preferably less than 27 dynes per $cm^2$, more preferably about 26.5 dynes per $cm^2$ or less. Surface tension can be lowered by any number of means known in the art.

Any number of suitable surface tension reducing agents, such as solvents, surfactants, acids, salts of acids, and mixtures thereof, may be added to the composition. Acids including, but not limited to, nitric, perchloric and dioctyl sulfosuccinic acid have been found to be very effective surface tension reducing agents. Using any of these acids is preferred because they serve two functions, formula acidification and surface tension lowering, thus reducing the number of components added to the formula.

Suitable surface tension reducing agents include acids or salts of acids selected from the group consisting of: alkyl sulfosuccinic, perchloric, nitric, benzoic, phthalic, naphthalic, naphthoic, β-hydroxynaphthoic, sulfanilic, anthranilic, hippuric, ρ-aminobenzoic, 4-nitro-4-amino-diphenylamine-2-sulfonic, quinizarin-2-sulfonic, sulfosalicylic, trichloroacetic, salicylic, p-dimethylaminobenzoic, adipic, succinic, butanetetracarboxylic, p-aminosalicylic, isatinacetic, 1-amino-4-bromoanthraquinone-2-sulfonic, 1,8-aminonaphthol-3,6-disulfonic, polyacrylic, uric, hydroxyphenylquinolindicarboxylic, picric, 2,4-dichlorophenoxyacetic, tannic, phenylhydrazine-2-sulfonic, picrolonic, anthraflavinic, 2,3,6-naphtholdisulfonic, 2,6-naphtholsulfonic, monochloracetic and mixtures thereof.

The preferred surface tension reducing agents are selected from the group consisting of the free acids or salts of nitrates, perchlorates and alkyl sulfosuccinates, (e.g., diisobutyl, dihexyl, dioctyl ditridecyl, nonoxynol-10), and dicarboxyethyl sulfosuccinamate. The levels of the surface tension reducing agents can vary. Only small amounts of the preferred surface tension reducing agent are required, e.g., from 0.005 to 2% by weight of the concentrated compositions; preferably from 0.01 to 1 part.

Table III summarizes disinfectancy as a function of surface tension.

TABLE III

Reduction of Surface Tension Restores Disinfectancy

| Composition | Solution pH | Surface Tension/dyne/$cm^2$ | Disinfectancy Results* |
|---|---|---|---|
| R | 4.5 | 29.2 | 10/10 |
| S | 4.5 | 28.5 | 10/10 |
| T | 4.5 | 27.2 | 3/10 |
| U | 4.5 | 26.6 | 0/10 |
| V | 4.5 | 26.0 | 0/10 |
| W | 4.5 | 25.2 | 0/10 |

*Staphylococcus aureus*

Composition R is the same as the mildly acidic amine oxide composition of Comparative Example 1 of Table IV. Compositions S-W are essentially the same except for their level of surface tension reducing agent. Composition W is the same as the composition of Example 3 disclosed in Table IV herein below.

Any suitable low surface tension surfactant can also be used. A compatible surface tension reducing adjunct surfactant can be selected from anionic, nonionic, and zwitterionic surfactants. The limitation on this surfactant is that it must reduce the surface tension of the dilute compositions to about 27 dynes per $cm^2$ or less and be compatible with the other essential components of the compositions of this invention. Such suitable adjunct surfactants can include the alkyl- and alkylethoxylate-(polyethoxylate) sulfates, paraffin sulfonates, olefin sulfonates, alkoxylated (especially ethoxylated) alcohols and alkyl phenols, alpha-sulfonates of fatty acids and of fatty acid ester, and the like. In general, the detergent surfactants contain an alkyl group in the $C_6$–$C_{18}$ range. The anionics can be used as their sodium, potassium, ammonium or alkanol ammonium salts. The nonionics often contain from about 5 to about 17 ethylene oxide groups. The zwitterionics generally contain both a quaternary ammonium group and an anionic group selected from sulfonate and carboxylate groups.

In one preferred embodiment, the compositions are used to clean waxed floors. Compositions which are used to clean waxed floors are preferably substantially free of compounds which tend to strip, i.e. remove, wax from waxed floors. Compounds having such a detrimental effect on floor wax include ammonium alkyl ethoxylated sulfate surfactants, ammonium alkyl surfactants, and glycol ethers, such as mono- and dialkyl ethers of ethylene glycol and diethylene glycol, commonly referred to as cellosolves and carbitols. Concentrated compositions used for cleaning waxed floors will preferably have less than 5%, more preferably less than 1%, even more preferably less than 0.5%, and most preferably 0% of compounds which are capable of stripping wax from floors.

Detailed listing of suitable surfactants, can be found in U.S. Pat. No. 4,557,853, to Collins, issued Dec. 10, 1985, which disclosure is incorporated herein by reference. Commercial sources of such surfactants can be found in McCutcheon's *Emulsifiers and Detergents,* North American Edition, 1992, McCutcheon Division, MC Publishing Company, which is also incorporated herein by reference. Some other surfactants suitable for use herein are described in the broad surfactant disclosure of U.S. Pat. No. 4,287,080 to Siklosi, issued Sep. 1, 1982, which disclosure is incorporated herein by reference in its entirety.

AQUEOUS CARRIER LIQUID

The compositions herein are employed on hard surfaces in liquid form. Accordingly, the foregoing components are admixed with an aqueous carrier liquid. The choice of aqueous carrier liquid is not critical. It must be safe and it must be chemically compatible with the components of the compositions. It should be either neutral or acidic to minimize the amount of acidifying agent needed. Compositions used for cleaning waxed floors preferably comprise carriers which do not strip wax.

The aqueous carrier liquid can comprise solvents commonly used in hard surface cleaning compositions. Such solvents must be compatible with the components of the compositions and must be chemically stable at the mildly acidic pH of the compositions. They should also have good filming/residue properties. Solvents for use in hard surface cleaners are described, for example, in U.S. Pat. No. 5,108,660, issued to Michael, 1992, which is incorporated herein by reference.

Preferably, the aqueous carrier liquid is water or a miscible mixture of alcohol and water. Water-alcohol mixtures are preferred inasmuch as the alcohol can aid in the dispersion and dissolution of the amine oxide and other materials in the compositions. Moreover, the alcohol can be used to adjust the viscosity of the compositions. The alcohols are preferably $C_2$–$C_4$ alcohols. Ethanol is most preferred. Preferably, the aqueous carrier liquid is water or a water-ethanol mixture containing from about 0 to about 50% ethanol.

Compositions which are used to clean waxed floors are preferably substantially free of solvents which tend to strip wax from waxed floors. Although processing of the quat disinfectant may result in some residual alcohol in the product, preferably additional solvents capable of stripping wax will not be added. Compositions used for cleaning waxed floors will preferably have less than 5%, more preferably less than 1%, even more preferably less than 0.5%, and most preferably 0% of solvent which are capable of stripping wax from floors.

NON-LIQUID FORMULATION

The present invention also embodies a non-liquid composition from which the mildly acidic, liquid hard surface cleaning compositions can easily be obtained by adding an aqueous carrier liquid. The non-liquid compositions can be in granular, powder or gel forms, preferably in granular forms.

The non-liquid compositions generally comprise the higher levels of the component of the composition described herein except for the aqueous carrier.

The non-liquid compositions also comprise an acidifying agent as described herein, preferably an organic acidifying agent. The non-liquid compositions contain enough of the acid to provide, upon dilution with the aqueous carrier liquid, a pH and percent amine oxide protonation within the ranges described herein for the mildly acidic, liquid compositions.

The non-liquid gel compositions contain reduced amounts of the aqueous carrier liquid. The non-liquid granular compositions contain substantially no aqueous carrier liquid. In either form, an aqueous carrier liquid is added to the liquid composition prior to use to form the mildly acidic, liquid hard surface cleaning compositions of the present invention.

AUXILIARY MATERIALS

Optionally, the compositions herein can contain auxiliary materials which augment cleaning and aesthetics.

The compositions can optionally comprise a non-interfering auxiliary surfactant in addition to the amine oxide detergent surfactant. Additional auxiliary surfactants can effect cleaning activity. A wide variety of organic, water soluble surfactants can optionally be employed. The choice of auxiliary surfactant depends on the desires of the user with regard to the intended purpose of the compositions and the commercial availability of the surfactant. Compositions used for cleaning waxed floors preferably comprise surfactants which do not strip wax, and are preferably substantially free of surfactants which do strip wax.

Other optional additives such as perfumes, brighteners, enzymes, colorants, and the like can be employed in the compositions to enhance aesthetics and/or cleaning performance.

Detergent builders can also be employed in the compositions. Detergent builders sequester calcium and magnesium hardness ions that might otherwise bind with and render less effective the auxiliary surfactants or cosurfactants. Builders are especially useful when auxiliary surfactants or cosurfactants are employed, and are even more useful when the compositions are diluted prior to use with exceptionally hard tap water., e.g., above about 12 grains/gallon. The detergent builders can be employed in the compositions at concentrations of between about 0 and about 10%.

Suds suppressors are especially useful in the composition. In the hard surface cleaning composition herein, suds formation and maintenance are undesirably promoted by the amine oxide component. The compositions therefore preferably comprise a sufficient amount of a suds suppresser to prevent excessive sudsing during employment of the compositions on hard surfaces. Suds suppressors are especially useful in formulations for no-rinse application of the composition.

The suds suppresser can be provided by known and conventional means. Selection of the suds suppresser depends on its ability to formulate in the compositions, and the residue and cleaning profile of the compositions. The suds suppresser must be chemically compatible with the components in the compositions, it must be functional at the pH range described herein, and it should not leave a visible residue on cleaned surfaces.

Low-foaming cosurfactants can be used as suds suppresser to mediate the suds profile in the compositions. Cosurfactant concentrations between about 1 part and about 3% are normally sufficient. Examples of suitable cosurfactants for use herein include block copolymers (e.g., Pluronic® and Tetronic®, both available from BASF Company) and alkylated (e.g., ethoxylated/propoxylated) primary and secondary alcohols (e.g., Tergitol®, available from Union carbide; Poly-Tergento, available from Olin Corporation).

The optional suds suppressor preferably comprises a silicone-based material. These materials are effective as suds suppressors at very low concentrations. The compositions preferably comprise from about 0.01 to about 0.50%, more preferably from about 0.01 to about 0.3% of the silicone-based suds suppresser. At these low concentrations, the silicone-based suds suppresser is less likely to interfere with the cleaning performance of the compositions. An example of suitable silicone-based suds suppressors for use in the compositions is Dow Coming® DSE. These optional but preferred silicone-based suds suppressors can be incorporated into the composition by known and conventional means.

BENEFITS

In addition to their reduced vinyl staining described herein before, the compositions also have surprisingly superior cleaning and disinfecting properties and leave little or no visible residue on hard surfaces when they dry. The composition of this invention can be used for cleaning and disinfecting toilets, etc., as well as other hard surfaces.

It was found that these compositions leave surprisingly little or no visible residue on hard surfaces whether used in a rinse or no-rinse application. They are also surprisingly wax compatible. As described herein before, at least about 10% of the amine oxide species in the composition are cationic. Ionic surfactants, however, tend to form crystalline salts upon drying thus resulting in cloudy residues. This does not occur, however, with the application (rinse or no-rinse application) of the instant compositions to hard surfaces.

It was also found that the compositions exhibit excellent particulate and greasy soil removal properties. This was surprising since mildly acidic liquid hard surface cleaners do not typically clean particulate or greasy soil from hard surfaces as well as non-acidic hard surface cleaners do. Acidic hard surface cleaners are used mostly in bathrooms to remove hard water stains.

The compositions provide excellent soil removal properties without leaving a visible residue or causing notable damage. Hard surface cleaners typically have either good soil removal properties or good residue properties (e.g., they do not leave a visible residue on cleaned surfaces), but not both. The compositions herein provide both of these desirable properties in a single product. It is therefore uniquely suited to clean, for example, heavily soiled shiny surfaces, e.g., waxed vinyl floors.

METHOD OF USE

The present invention has been fully set forth in its composition aspects. The invention also encompasses methods for cleaning and disinfecting hard surfaces, including vinyl surfaces (waxed or unwaxed). The benefit of using this composition on hard surfaces is described herein before.

One method comprises applying to a hard surface the mildly acidic liquid compositions herein or, preferably, applying an aqueous dilution thereof. The hard surface is then wiped with a porous material,. e.g., cloth or mop, and allowed to dry.

In one preferred method, the mildly acidic composition is first diluted with an aqueous liquid, preferably tap water. The diluted composition has a pH of between about 3.0 and below about 7.0, preferably between about 4.0 and about 6.0, and comprises from about 40 ppm to about 12,500 ppm, preferably from about 100 ppm to about 2800 ppm, of the amine oxide detergent surfactant described herein and has quat at a level of about 600 ppm to disinfect and about 150 ppm to sanitize. At least about 10% of the amine oxide species in the diluted composition is protonated, preferably from about 50% to about 100%, more preferably from about 70% to about 100%. The diluted composition has a surface tension of less than about 27 dyne per $cm^2$. The diluted composition is then applied to the hard surface and allowed to dry.

In another preferred method, the mildly acidic concentrated composition of this invention is first diluted with an aqueous liquid, preferably tap water. The concentrated compositions contain from about 0.05 to about 10 percent of an acidifying agent to protonate the amine oxide and provide the desired pH. The diluted composition has a pH of between about 3.0 and less than about 7.0, preferably between about 4.0 and about 6.0, and comprises from about 40 to about 12,500, preferably about 200 ppm to about 2000 ppm, more preferably from about 400 ppm to about 1000 ppm, of the amine oxide detergent surfactant described herein; and has a disinfecting quat at a level of about 500 to about 700 ppm. At least about 10% of the amine oxide species in the diluted composition are protonated, preferably from about 50% to about 100%, more preferably from about 70% to about 100%. The preferred compositions have a surface tension of less than about 26.5 dynes per $cm^2$. The diluted composition is then applied to a hard surface and allowed to dry without rinsing.

A preferred method for cleaning large floor surfaces uses an automatic scrubber. Such automatic scrubbers are commercially available, and automatically apply the cleaning composition, scrub the floor, and squeegee and remove used cleaning composition. One preferred method for cleaning floors with an automatic scrubber uses a diluted cleaning composition comprising from about 40 parts per million (ppm) to about 12,500 ppm of amine oxide detergent and from about 50 ppm to about 1500 ppm of quaternary disinfectant (quat); at least about 10% of the amine oxide detergent within the diluted composition is protonated, and the diluted composition has a pH of from about 3 to less than about 7 and a surface tension of about 27 dyne per $cm^2$ or less.

EXAMPLES

The following examples illustrate the compositions of the present invention (Examples 3 and 4) as well as comparative examples (Comparative Examples 1 and 2) Unless specified otherwise, amounts are in parts by weight.

The compositions of the following Examples (Table IV) are prepared by mixing the ingredients in no particular order. The concentrated compositions are diluted 1:128 by volume with water and tested for cleaning and disinfecting. The diluted composition of Example 4 is most effective against both gram positive and gram negative organisms. The pH values of the concentrated compositions are about 4.5. The pH values of the dilute compositions are about 4.5 to about 5. The surface tension of the preferred dilute compositions of Examples 3 and 4 are respectively 25.2 and 25.4 dynes per $cm^2$. The surface tensions of Comparative Examples 1 and 2 are, respectively, 29.5 and 28 dynes per $cm^2$. The levels of minors, such as colorants and miscellaneous ingredients are not shown.

TABLE IV

Surface Tension and Effect on Disinfectancy

| Composition Component | Comp. Ex. 1 | Comp. Ex. 2 | Ex. 3 | Ex. 4 |
|---|---|---|---|---|
| Amine Oxide‡ | 9.00 | 9.00 | 9.00 | 9.00 |
| Quaternary Ammonium† | 7.68 | 7.68 | 7.68 | 7.68 |
| $H_4EDTA$ | 0.00 | 1.50 | 0.00 | 1.50 |
| Phosphoric Acid | 1.00 | 1.00 | 1.00 | 1.00 |
| Hydrochloric Acid | 0.50 | 0.30 | 0.50 | 0.20 |
| Perchloric Acid | 0.00 | 0.00 | 0.17 | 0.17 |
| Poly-tergent CS-1* | 1.00 | 0.50 | 0.50 | 0.50 |
| Silicone Suds Suppressor** | 0.08 | 0.08 | 0.08 | 0.02 |
| Perfume | 0.40 | 0.40 | 0.40 | 0.40 |
| Water | Bal. | Bal. | Bal. | Bal. |
| Formula pH | 4.45 | 4.5 | 4.5 | 4.5 |
| Solution Surface Tension*** dynes per $cm^2$ | 29.5 | 28 | 25.2 | 25.4 |
| Staining | none | none | none | none |
| Disinfectancy @ 1:128 dilution**** | | | | |
| *Staphylococcus aureus* | 10/10 | 10/10 | 0/10 | 0/10 |
| *Salmonella choleraesuis* | 0/10 | | 1/10 | 0/10 |
| *Pseudomonas aeruginosa* | 4/10 | | 1/10 | 0/10 |

‡coconut dimethyl amine oxide
†Didecyl Dimethyl Ammonium Chloride
*EO/PO surfactants
**DOW Corning AF-GPC
***Surface tension of the Examples at 1:128 dilution of concentrate in tap water; the ppm for the diluted compositions is calculated by multiplying the parts by 10,000 ÷ 128.
****To be classified as a hospital grade disinfectant under EPA guidelines, all 3 organisms must be killed.

Comparative Example 1 shows that a liquid composition containing a protonated amine oxide and a quat disinfectant with a surface tension of 29.5 dynes per $cm^2$ will not kill staphylococcus aureus or pseudomonas aeroginosa, whereby the compositions can not be classified as a hospital grade disinfectant under EPA guidelines.

When the surface tension of the Comparative Example 1 is lowered with perchloric acid (Example 3) to 25.2 dynes per $cm^2$, disinfectancy on gram positive (Staphylococcus aureus) bacteria is achieved; none of the 10 inoculated tubes exhibited bacterial growth. However, reducing the surface tension of the formulation alone does not deliver complete gram negative (Salmonella choleraesuis and Pseudomonas aeruginosa) kill; 1 of the 10 Salmonella choleraesuis inoculated tubes and 1 of the 10 Pseudomonas aeruginosa inoculated tubes exhibited bacterial growth. Example 4 is similar to Example 3 except that ethylenediamine tetraacetic acid (EDTA) is added in Example 4 at a level of 1.5 parts by weight; with the addition of EDTA full Hospital Grade disinfectancy is achieved. Note that EDTA is included in Comparative Example 2, but it alone could not boost gram positive (Staphylococcus aureus) disinfectancy by itself when the surface tension is 28 dynes per $cm^2$.

Some preferred variations of the preferred composition (Example 4) comprises: about 8 to 10 parts amine oxide surfactants; about 6–8 parts quaternary ammonium chloride; about 1–3 parts EDTA; about 0.5 to 1.2 parts phosphoric acid; about 0.01 to 1 part perchloric acid; and balance water. The pH is preferably adjusted with HCl or phosphoric acid or mixtures thereof. All variations kill gram positive and gram negative organisms.

Having described the preferred embodiments of the present invention, further adaptions of the compositions and methods described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the compositions and methods described in the specification.

What is claimed is:

1. A concentrated floor cleaning and disinfecting composition comprising, by weight of the concentrated composition:

a) from about 9% to about 25% amine oxide detergent b) from about 7% to about 16% quaternary disinfectant;

c) from about 1% to about 3% ethylenediamine tetraacetic acid (EDTA);

d) from about 1.0% to about 2.0% acidifying agent selected from tho group consisting of phosphoric acid, hydrochloric acid or mixture thereof;

e) from about 0.15% to about 1% surface tension reducing agent selected from the group consisting of perchloric acid, perchloric acid salts, and mixtures thereof; and wherein when the concentrated cleaning composition is diluted to form a diluted composition having a concentration of amine oxide of 0.5%, the diluted composition has a surface tension of about 27 dynes per $cm^2$ or less, a pH of from about 3 to about 7; and at least 10% of the amino oxide detergent within the diluted composition is protonated.

2. A concentrated floor cleaning and disinfecting composition according to claim 1 wherein the amine oxide has the formula RR'R"NO, wherein R is an alkyl or alkene group containing from about 8 to about 18 carbon atoms; and R' and R" each independently is an alkyl or alkene group containing from about 1 to 4 carbon atoms.

3. A concentrated floor cleaning and disinfecting composition according to claim 1 wherein the quaternary disinfection has the formula:

$$[R_1R_2R_3R_4N]^+X^-$$

wherein $R_1$ and $R_2$ each independently is a benzyl group or an alkyl or alkylene containing from about 8 to about 20 carbon atoms, and wherein no more than one of $R_1$ and $R_2$ is benzyl;

$R_3$ and $R_4$ each independently is a benzyl group or an alkyl or alkylene containing from about 1 to about 4 carbon atoms, and wherein no more than one of $R_3$ and $R_4$ is benzyl; and X is a halogen atom, sulfate or nitrate.

4. A concentrated floor cleaning and disinfecting composition according to claim 1, wherein said concentrated cleaning and disinfecting composition is diluted with water at a ratio of concentrate to water of from about 1:1 to about 1:128 by volume to produce a diluted cleaning and disinfecting composition.

5. A diluted floor cleaning and disinfecting composition according to claim 1 having a pH of from about 4 to about 6; and a surface tension below about 26.5 dynes per $cm^2$, and wherein from about 10% to about 100% of the amine oxide detergent in the diluted composition is protonated.

6. A diluted floor cleaning and disinfecting composition according to claim 1 wherein the quaternary disinfectant is selected from the group consisting of dioctyl, octyldecyl and didecyl dimethyl ammonium chloride, N-alkyl ($C_{12}$ to $C_{18}$) dimethyl ammonium chloride, and N-alkyl ($C_{12}$ to $C_{18}$) dimethyl ethylbenzyl ammonium chloride, and mixtures thereof.

* * * * *